US006125357A

United States Patent [19]

Pintsov

[11] Patent Number: 6,125,357

[45] Date of Patent: Sep. 26, 2000

[54] DIGITAL POSTAL INDICIA EMPLOYING MACHINE AND HUMAN VERIFICATION

[75] Inventor: Leon A. Pintsov, West Hartford, Conn.

[73] Assignee: Pitney Bowes Inc., Stamford, Conn.

[21] Appl. No.: 08/943,404

[22] Filed: Oct. 3, 1997

[51] Int. Cl.[7] ..... G07B 17/04

[52] U.S. Cl. ..... 705/408; 380/51; 380/55; 705/62; 705/410

[58] Field of Search ..... 101/71; 283/71; 380/23, 25, 51, 55; 705/401, 408, 410, 62

[56] References Cited

U.S. PATENT DOCUMENTS

| | | | |
|---|---|---|---|
| 4,725,718 | 2/1988 | Sansone et al. | 235/495 |
| 4,743,747 | 5/1988 | Fougere et al. | 235/494 |
| 4,757,537 | 7/1988 | Edelmann et al. | 380/51 |
| 4,775,246 | 10/1988 | Edelmann et al. | 380/23 |
| 4,831,555 | 5/1989 | Sansone et al. | 364/519 |
| 4,853,865 | 8/1989 | Sansone | 364/464.02 |
| 4,873,645 | 10/1989 | Hunter et al. | 364/479 |
| 5,390,251 | 2/1995 | Pastor et al. | 380/21 |
| 5,454,038 | 9/1995 | Cordery et al. | 380/23 |
| 5,535,279 | 7/1996 | Seestrom | 380/55 |
| 5,602,921 | 2/1997 | Ramadei | 380/51 |
| 5,682,427 | 10/1997 | Seestrom | 380/51 |
| 5,835,604 | 11/1999 | Lee | 380/23 |

OTHER PUBLICATIONS

Alfred J. Menezes, Paul C. van Oorschot, Scott A. Vanstone, "Handbook of Applied Cryptography", 1997, pp. 33, 323, 352–359, 381–383, and 425–488.

*Primary Examiner*—Edward R. Cosimano
*Attorney, Agent, or Firm*—Alberta A. Vitale; Michael E. Melton; Charles R. Malandra, Jr.

[57] ABSTRACT

The present invention is a method of encrypting unique addressee information into the indicium of a mail piece and verifying the indicium. Local digital tokens are printed in the indicium of the mail piece and point to pivotal address characters in the addressee block. The pivotal address characters are also printed in the indicium. Additionally, a global digital token is included in the indicium.

13 Claims, 4 Drawing Sheets

DIGITAL POSTAL INDICIA EMPLOYING MACHINE AND HUMAN VERIFICATION

FIELD OF THE INVENTION

The invention disclosed herein relates generally to electronic value metering systems and, more particularly to a postage evidencing system employing electronic and human verification.

BACKGROUND OF THE INVENTION

Mechanical postage meters have been used for many years to print postage indicium and other value. Mechanical meters do not have an independent accounting system to account for the postage printed by the meter; nor do they print postage indicia for which duplicate copies can be readily detected. Digital postage meters, capable of interfacing with independent accounting systems and capable of producing indicia with encrypted and/or additional information provide a partial solution to the problem. The digital indicia have been printed with various encrypted information generated from indicia information and address blocks.

U.S. Pat. No. 4,853,865 discloses a mailing system with postage value printing capability which prints the indicia and an address line containing the postage amount, the date and the transaction number. U.S. Pat. No. 4,831,555 discloses a postage applying system which prints an postage amount, customer number and zip code and an encrypted postage amount, customer number and zip code which can be decrypted by a computer at the postal service and used to determine the genuineness of the postage. U.S. Pat. No 5,454,038 discloses an electronic data interchange postage evidencing system which performs address hygiene to obtain correct information, encrypts the address information and prints the encrypted information in the postal indicia. U.S. Pat. Nos. 4,725,718 and 4,743,747 disclose postage mailing and information applying systems which apply address information and encrypted information containing the mail piece zip code. The system provides a connection between the zip code, the mail piece and the encrypted message. The encrypted information can be decrypted by a computer system so that the genuiness of the postage can be determined. The above systems, while providing methods of creating unique postage indicia, do not provide a method for creating a postage indicium unique to the mail piece, virtually unduplicatable and which can be verified by a person such as a postal worker with or without the assistance of a computer. Another example of where address information has been used has been used is disclosed in U.S. Pat. No. 5,835,605 issued Nov. 10, 1998 for a method of mapping destination addresses for use in calculating digital tokens (attorney docket number E-417), the entire disclosure which is incorporated by reference.

Digital postal indicium produced by digital postage meters should evidence that postage for a given mail piece has been paid. Therefore, it is desirable that the digital postal indicia satisfy the following requirements: (1) information printed in the indicium be linked to payment; (2) each digital indicium be unique; and (3) each digital indicium be linked with the mail piece for which it provides evidence of payment. Additionally, the indicium verification process should be simple and effective, i.e. completely automated or a simple manual process performed by mail carriers handling the mail for delivery.

The first requirement, that the information printed in the indicium be linked to payment, is typically satisfied by using cryptographic techniques. A technique for linking payment and indicium employs the computation and printing of the indicium containing a pseudo-random information or digital token. The computation can be performed by a device containing a secret key. This secret key serves as an input to an algorithm producing a Message Authentication Code (MAC) or a digital signature. Encryption may be based upon any recognized code, for example, encrypt may be in accordance with the NBS Data Encryption Standard (DES) pursuant to a preset secure key. Each access to the secret key results in accounting action, e.g. subtraction of the postage from a postage register holding postal money.

The second requirement, that each digital indicium be unique, is necessary in order to provide a detection mechanism for unauthorized duplication of the indicium. This requirement is satisfied by printing unique identification on each mail piece.

The third requirement, that digital indicium be linked with the mail piece for which it provides evidence of payment, is desirable in order to simplify the detection of reused or duplicate indicia. In particular, it is very desirable to achieve the verification of the indicium without access to external sources of information, such as data bases of already used and verified indicia. This requirement considerably simplifies means for satisfying the last requirement, that the indicium verification process be simple and effective.

The linkage between the mail piece and the indicium should include data unique to a mail piece as an input to a cryptographic transformation which generates, as in the preferred embodiment, digital tokens. Analysis of data present on the mail pieces reveals that there is only one candidate for providing such unique data as an input for the cryptographic transformation, namely the destination address. By incorporating the destination address and date into the MAC or digital signature, the possibility of copying an issued (and paid) digital postal indicium on another mail piece is effectively eliminated with the exception of a mail piece destined to exactly the same address on the same day. This last modality of fraud is not considered to be a serious problem since it provides very little economic benefit to the perpetrator. Thus, it is desirable to integrate the destination address into digital tokens printed in the postal indicium.

The process of producing digital tokens by postage evidencing devices is well known and is described in U.S. Pat. No. 4,757,537 for SYSTEM FOR DETECTING UNACCOUNTED PRINTING IN A VALUE PRINTING SYSTEM; U.S. Pat. No. 4,831,555 for UNSECURED POSTAGE APPLYING SYSTEM; U.S. Pat. No. 4,775,246 for SYSTEM FOR DETECTING UNACCOUNTED FOR PRINTING IN A VALUE PRINTING SYSTEM; and, U.S. Pat. No. 4,873,645 for SECURE POSTAGE DISPENSING SYSTEM; AND U.S. Pat. No. 4,725,718 for POSTAGE AND MAILING INFORMATION APPLYING SYSTEM. The entire disclosure of these patents is hereby incorporated by reference.

Several difficulties are associated with incorporating destination address information into indicia, including: 1) address information and its presentation format should be standardized in such a way that verification process could produce, based upon the address present on the mail piece, the address input data exactly identical to the address input data which was used during indicium generation process by the postage evidencing device; and 2) this standardization should be international and suitable for any address in order to accommodate international mail and other type of mail which does not have numeric or alphanumeric postal codes. These requirements persist even if the address information printed within the indicium is in a machine readable format such as, for example, a two dimensional bar code.

The root of the difficulties in incorporating address information lies in the fact that the postage evidencing device computes indicium information, including digital tokens, from a computerized file of input data, while a verification process must compute digital tokens from the data scanned (or otherwise obtained) from the mail piece where this data exists in the form of optical images. The process of interpreting optical images in order to obtain a computerized file is notoriously error prone and the probability of error grows fast with the amount of information contained in the optical image. Additionally, cryptographic verification fails in the presence of even a single interpretation error. Thus, the cryptographic verification is unforgiving and not error tolerant. In the United States, the United States Postal Service (USPS) has defined an eleven digit Destination Point Delivery Code (DPDC) uniquely indicative of the destination address. The DPDC, when present on the mail piece and known to the postage evidencing device, can serve as the required input to the digital token transformation. Obtaining the DPDC requires access to, or possession of, a huge databases that must be updated on a frequent basis. The database updates pose a very significant financial burden for mailers. Additionally, in the United States, the DPDC is not defined for approximately 20% of addresses and an equivalent to the United States' DPDC does not exists in a vast majority of other countries including major countries of the industrial world. Thus, the utility of the DPDC for the purpose of cryptographic detection of copied indicia is considerably reduced. In summary, the DPDC does not always offer a practical and acceptable solution to achieving the goal of linking digital indicium to the mail piece.

SUMMARY OF THE INVENTION

It has been discovered that linking the digital postal indicium with the mail piece to provide evidence of payment can be substantially satisfied worldwide for all categories of mail, domestic and international, without employing DPDC or its equivalents.

It has been further discovered that a new method does not require access to the address data bases and works for all mail pieces, including those undeliverable as addressed.

It has been also discovered that the new method allows for simple manual verification by mail carriers, thus providing much greater deterrence effect than a method based on the DPDC.

The present invention is directed to, in a first aspect, a method of verifying a postal indicium comprising the steps of: (a) scanning the indicium to obtain indicium information including a local digital token; (b) computing a local digital token from the indicium information and a cryptographic key; (c) comparing the computed local digital token to the scanned local digital token to verify integrity and authenticity of the indicium; and (d) comparing indicium identification numbers to identification numbers stored in a database to detect unauthorized duplication of the indicium.

Another aspect of the present invention relates to a method of verifying a postal indicium comprising the steps of: (a) scanning the indicium to obtain indicium information including a global digital token and a pivotal address character; (b) scanning at least a portion of address block to obtain address block information; (c) computing a global digital token from the indicium information; (d) comparing the computed global digital token to the scanned global digital token to verify integrity and authenticity of the indicium; (e) employing the scanned local digital token to obtain a pivotal address character from the address block information; and (f) comparing the scanned pivotal address character with the address block pivotal address character to verify the validity of the indicium.

In another aspect, the present invention relates to a method of verifying a postal indicium comprising the steps of: (a) scanning the indicium to obtain indicium information; (b) computing a global digital token from the indicium information; (c) comparing the computed global digital token with an indicium global digital token to verify the integrity and authenticity of the indicium; (d) examining manually the indicium to obtain a local digital token and a pivotal address character; and (e) comparing the manually obtained local digital token and pivotal address character to the pivotal address character in the address block to verify the integrity and authenticity of the indicium.

In another aspect, the present invention relates to a mail piece containing an address block and a postal indicium, the postal indicium comprising: a pointer, the pointer corresponding to a location of an address character; and the address character obtained from the address block from a position corresponding to the pointer.

In another aspect, the present invention relates to a method of applying postage to a mail piece, the method comprising the steps of: (a) calculating a local digital token from indicia information; (b) calculating a global digital token from the indicia information; obtaining a pivotal address character using local digital tokens; and (c) printing a postal indicium containing the pivotal address character, the local digital token and the global digital token.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

In describing present invention, reference will be made herein to FIGS. 1–5 of the drawings in which like numerals refer to like features of the present invention. The terms right, left, top, bottom and middle have been used to describe placement of address lines and characters within address lines. These terms are used in their ordinary meanings to one of ordinary skill in the art. It is intended that this invention should not be limited to the particular language of the embodiments disclosed.

A system has been developed which employs local digital tokens, global digital tokens and pivot address characters. A local digital token is a ciphertext or a part thereof used to authenticate an indicia. It may be a truncated Message Authentication Code obtained by encrypting information in the indicium, such as date, postage, registration postal code and serial piece count and with the use of a secret key. Alternatively, local digital token can be a truncated digital signature obtained from the same elements of indicium and by using a public key crypto system. In this case, however, the entire digital signature has to be present in the indicium. Local digital token in the preferred embodiment is a single digit, however it could contain as many digits as desired. A global digital token is ciphertext or a part thereof used to authenticate an indicia. The ciphertext is obtained using the same input information as local digital token and including at least one pivotal character from a mail piece address block. The ciphertext may be a truncated Message Authentication Code obtained from the same elements of indicium information as local digital token and includes pivotal address characters pointed to by local digital tokens and, if desired, their corresponding local digital token. A pivotal address character is defined as at least one character present in the is address block (including spaces), for which position is defined by a local digital token, and which is included in computations of the global digital token and printed in the indicium.

Figure 1:
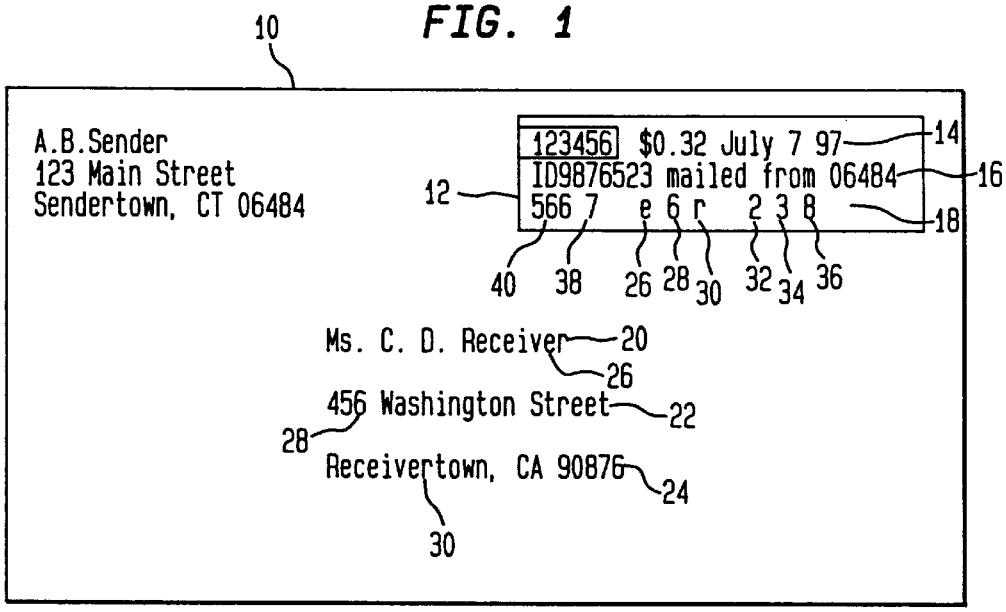
FIG. 1 is a plan view of a mail piece prepared in accordance with the present invention.

FIG. 1 illustrates a mail piece 10 with a postal indicium prepared in accordance with the present invention in which local digital tokens are used as pointers to characters in the address field or address block. The address block is collection of triplets, each triplet being (X, Y, ASCII (X, Y)) where X is the line number in the address block, Y is a position of the character in the line X of the address block, and ASCII(X, Y) is the identity of the character. The postal indicia 12 typically includes three lines (shown framed) of information: a first line 14 contains a mail piece count, a postage value and a mailed date; a second line 16 indicates a postage evidencing device identification number and a postal code of post office where postage evidencing device is registered (referenced below as registration postal code); and a third line 18 contains an error detection/correction code (EDCC) 40, a global digit token 38, pivotal address characters 26, 28 and 30 and local digital tokens 32, 34 and 36 corresponding to the pivotal address characters. The error detection/correction code 40 is employed for automatic error recovery during machine scanning and interpretation of indicium data. Another error detection/correction code may be employed for automatic error recovery during machine scanning and interpretation of the address block. The indicium and address block error detection/correction codes may be employed separately or in combination.

In the example mail piece 10, illustrated in FIG. 1, the first line 14 indicates a piece count 123456 (shown framed), a postage value $0.32 and a date shown as Jul. 7, 97. The second line 16 indicates an identification number ID9876523 and a registration postal code 06484. The third line 18 indicates an indicium error detection/correction code 566, a global digit token 7, pivotal address characters e 6 r and local digital tokens 2 3 8 corresponding to the pivotal address characters, respectively.

Local digital tokens 32, 34 and 36 are preferably generated from information contained in lines 14 and 16 of the indicium. However, other information could also be included in the calculation, if desired. The local digital tokens 32, 34 and 36 can be truncated Message Authentication Codes (MACs) and each MAC can be generated by a separate secret key or a single secret key can be used for all MACs. If a public key cryptographic system is preferred, then a digital signature is generated instead of a MAC. Digital signature algorithms and MACs are explained in Handbook of Applied Cryptography by A. Menezes, P. Van Oorshoot and S. Vanstone, CRC Press, 1997. In the preferred embodiment, a single key is used to generate the Message Authentication Code which is truncated to three digits which become the local digital tokens. The local digital tokens function as pointers to the address block, pointing to pivotal address characters. While three local digital tokens are preferred, the number of local digital tokens can be more or less than three. Additionally, two or more secret keys may be used to generate the MACs. One key could be controlled by the vendor of the postage meter and the other key controlled by the accepting post office. The idea of employing two separate secret keys is well known and is explained in U.S. Pat. No. 5,390,251 for a mail processing system including data center verification for mail pieces. Additionally, each local digital token can be used to compute an associated line pointer. Arithmetic such as, for example, mod 3 arithmetic, can be performed on each local digital token to produce a line pointer between 0 and 2 pointing to up to 3 lines in the address block. Thus, each token would define a line and position of a pivotal character within the line in the address block.

Local digital tokens can be produced by using different keys controlled by separate verification authorities. Indicium verification using address information requires knowledge of the local digital tokens which point to pivotal characters in the address block. These local digital tokens also must be verified to be trusted. Verification is accomplished by checking integrity of the indicium data by means of the global digital token (truncated MAC). Thus, the verification authority must have access to the secret key used for computing the global digital tokens. Access to the key (or keys) which was used to produce local tokens is delivered by an appropriate key management system.

The local digital tokens corresponding to the pivotal address characters are obtained by the digital token transformation explained above. The pivotal address characters are obtained from the mail piece 10 address lines 20, 22 and 24 and are pointed to by local digital tokens 32, 34 and 36. In the preferred embodiment, the first local digital token points to the first address line in the address block, the second local digital token points to the second line, and the third local digital token points to the third line; however, other conventions may be used to determine line pointers from the local digital tokens. In the example mail piece of FIG. 1, the local digital tokens 2, 3 and 8 point to positions in the address block lines. The first pivotal address character "e" represents the second character from the right in the first address line 20 (commas, periods and spaces are not counted). The second pivotal address character "6" represents the third character from the left in the second address line 22. The third pivotal address character "r" represents the eighth character from the left in the third address line 24. FIG. 1 indicates the pivotal address characters 26, 28 and 30 and the corresponding letters in the address lines 20, 22 and 24 in bold type for illustration purposes. Additionally, local digital tokens 32, 34 and 36 corresponding to the pivotal address characters 26, 28 and 30, respectively, are also shown in bold type.

A situation may arise during the mapping of local digital tokens to pivotal characters where no character is present for the address line and position being pointed to by one of the local digital token. In this situation, preferably a blank space will be produced for the corresponding Pivotal Address Character. For example, if the local digital token points to position 8 where no characters are present because the address line contains only 7 characters, a space represents the pivotal address character in the indicium to indicate this fact to the verifier. Alternately, a special character may be used in place of a space.

The global digital token is obtained by applying digital token transformation to all data in lines 14, 16 and 18 of the indicium except, obviously, for the global digital token. In the sample mail piece 10 of FIG. 1, the digit 7 shown in bold italics is the global digital token 38. In a similar fashion to the generation of the local digital tokens, the global digital token 38 can be generated from a single or multiple digit truncated MACs or from a digital signature.

Figure 2:
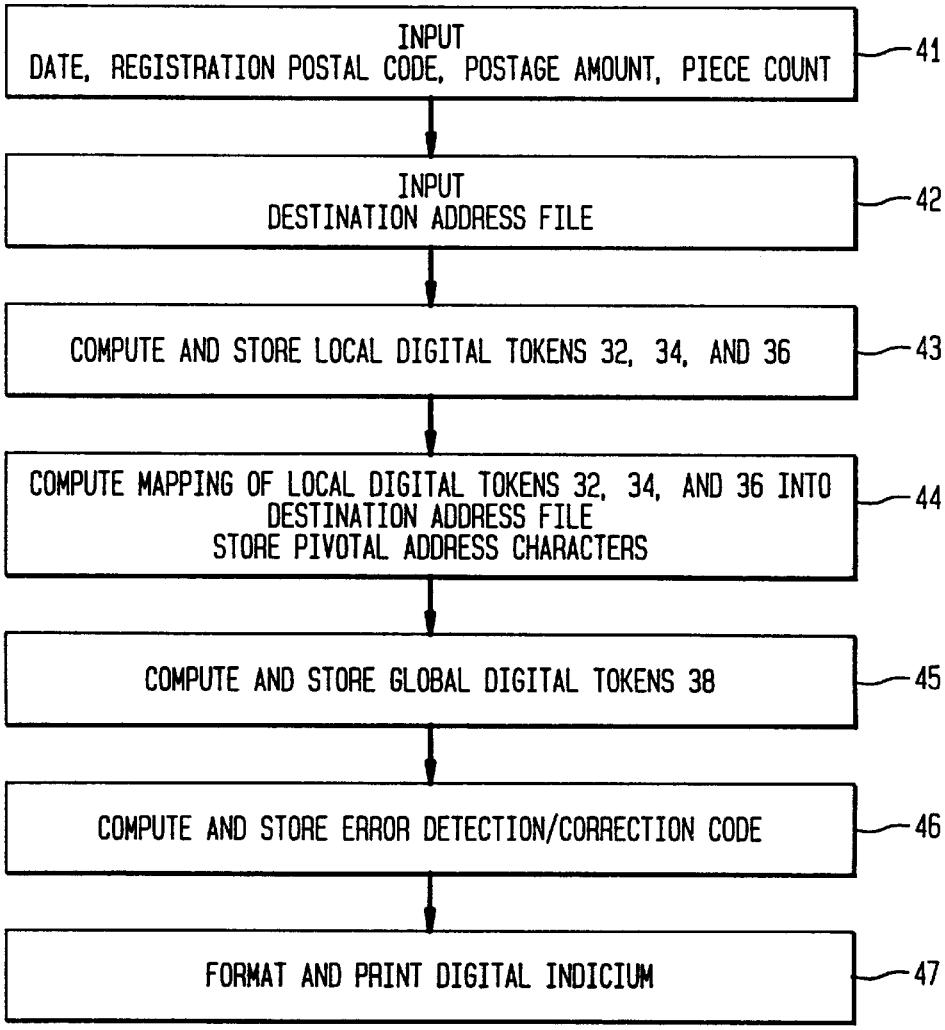
FIG. 2 is a flow chart of an indium generation process of the present invention.

FIG. 2 is a flow chart of the indicium generation process of the present invention. At 41, the date, registration postal code, postage amount and piece count are input into digital meter (postage evidencing device) (not shown). At 42, a destination address is input, for example, from a data file. At 43, the local digital tokens 32, 34 and 36 are generated. At 44, the local digital tokens 32, 34 and 36 are mapped into a destination address file to obtain pivotal postal address characters which are then stored. At 45, the global digital token 38 is computed and stored. At 46, the error detection/correction code 40 is computed and stored. At 47, the digital indicium is formatted and printed onto a mail piece. The activities of flow chart blocks 41 through 46 occur in the vault or accounting module of the digital postage meter.

The mapping of local digital tokens (as well as the number of such tokens) to the characters in the address block is not arbitrary and should be designed to provide maximum protection against duplication. In the present invention, duplication is defined as the process of finding two or more legitimate addresses where the mail pieces are to be sent and determining which addresses would have identical pivotal address characters 26, 28 and 30 in the positions pointed to by the local digital tokens 32, 34 and 36.

One method of providing maximum protection against duplication is to determine the fields within the address block which have maximum variability. The address block is made up of several lines of information including from bottom to top: country, administrative district, city or town, street address and recipient name. The variability typically increases from the bottom to the top of the address block since, for example, there are only about 200 countries, and within the countries, there are a relatively small number of administrative districts, i.e. 50 states of the United States, and there is a larger number of cities and towns having an even larger number streets and even larger number of individual recipients.

Since the first line of the address block is most frequently entirely under control of the mailer, care should be exercised not to point to identical characters in the standard words such as Mr., Ms., President, Accounting Department etc., which can almost always be added to the first line of the address. Hence, the character count of the top address line should begin in the rightmost position as illustrated in FIG. 1 with Pivotal Address Character 26 which, in the example mail piece, is the second character from the right. Since the second line is typically the street address line, the character count should begin in the leftmost position as illustrated in FIG. 1 with pivotal address character 28 so as to avoid common words such as street, road, place or the like. The third line typically indicates city and state. Since there are many more cities than states, the character count should begin in the leftmost position as illustrated in FIG. 1 with pivotal address character 30 so as to avoid obtaining a pivotal address character from the name of the state in the address block. Additional address lines may also be present in the address block, thus additional local digital tokens and pivotal address characters may be appropriate for some mail pieces.

A purpose of the method of the present invention is to provide an effective deterrence and detection mechanisms for duplicated digital indicia. Thus, if an unscrupulous mailer arbitrarily changes the first line of the address by introducing boiler plate words on each side of the variable name, such event is easily detectable by mail carriers and other postal personnel with access to the mail. These mail pieces will arouse suspicion by the unusual format of the changed address, and point to the unscrupulous mailer. This will warrant investigation which can easily detect the fraud upon interception of several different pieces with identical indicia.

The verification process can be organized in several ways thereby leaving a postal administration or a carrier in control of the revenue protection measures. The postal administration or carrier may choose from several verification methods explained as follows.

Figure 3:
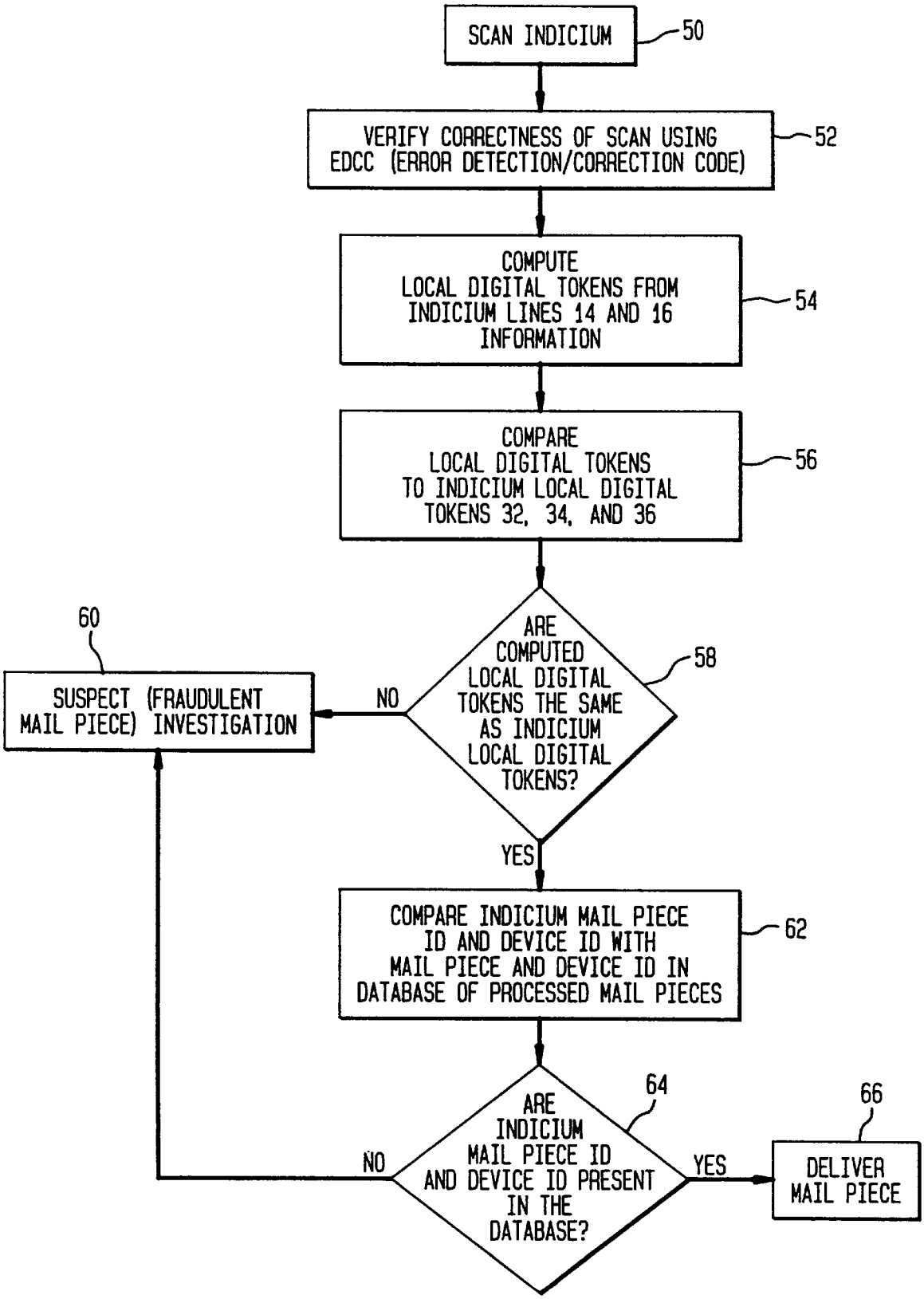
FIG. 3 is a flow chart of a method of indicium verification of the present invention.

In a first method verification is performed by verifying the local digital tokens and checking the identifications numbers for duplicates. Using this method, a postal administration may automatically verify the local tokens produced with the postally controlled secret key(s) and thus assure the integrity of the indicium data, but not the address data. If the database of the processed indicium ID number is available, the postal administration can then detect duplicates without looking at the address block. This is a traditional verification method. FIG. 3 illustrates a flowchart of this verification process. At 50, the indicium is scanned. At 52, the indicium scan is verified using the error detection/correction code 40. At 54, local digital tokens are computed using indicium information from indicium lines 14 and 16. At 56, the local digital tokens are compared to indicium local digital tokens 32, 34 and 36. At 58, a query is made as to whether the local digital tokens match the indicium local digital tokens. If the local digital tokens do not match, then the suspected fraudulent mail piece is investigated at 60. If the verification process is successful, at 62, the mail piece identification and device identification numbers are compared to identification numbers in a database of identification numbers. At 64, the query is made as to whether the verification is successful. If the verification is not successful, the suspect fraudulent mail piece is investigated at 60. If the verification is successful, the mail piece is delivered at 66.

Figure 4:
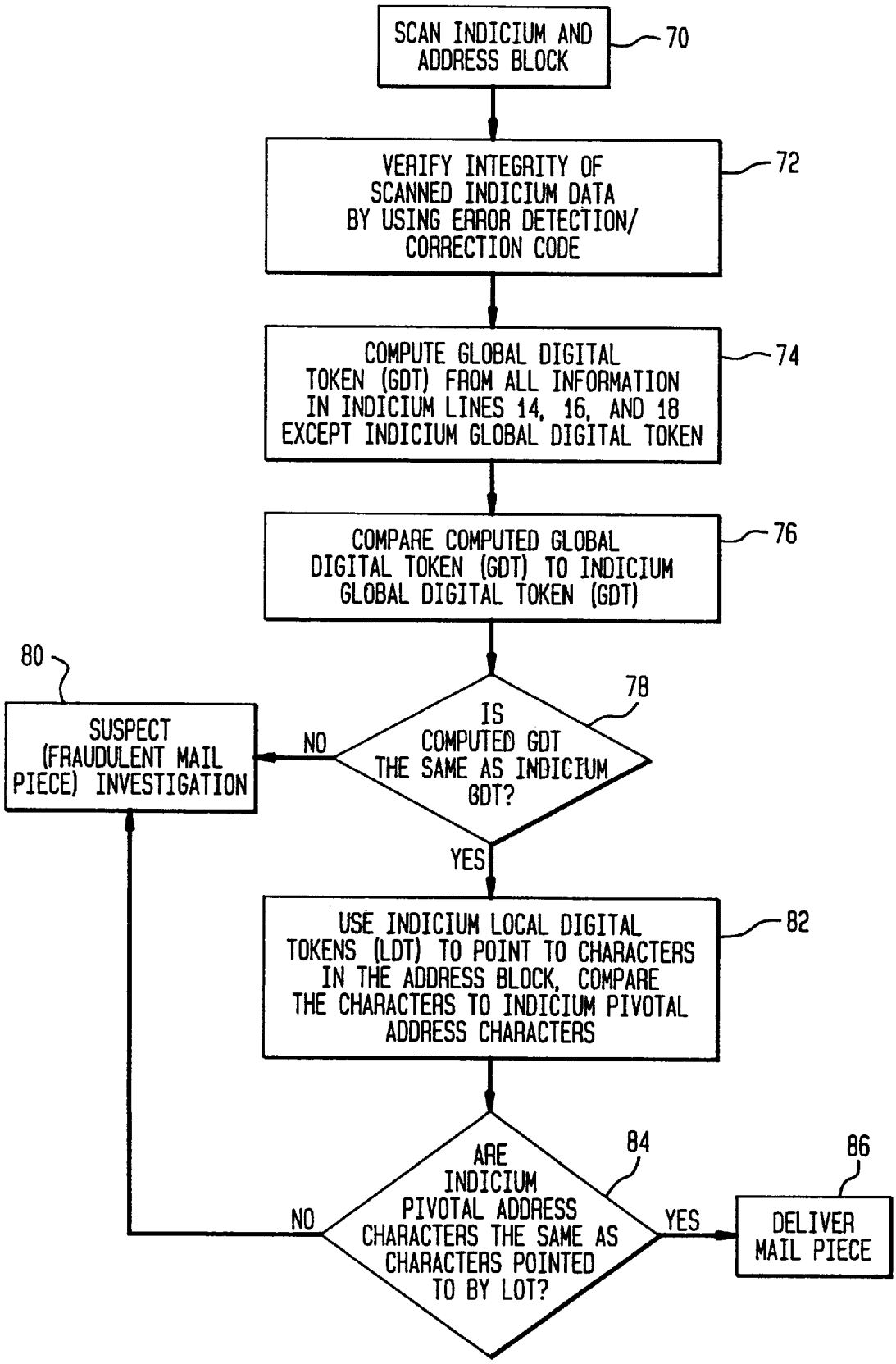
FIG. 4 is a flow chart of another method of indicium verification of the present invention.

In a second method, the verification can be done in a completely automated fashion employing scanning and verification equipment and by either sampling a portion of, or verifying the entire mail stream. FIG. 4 illustrates a flow chart of this method. At 70, the indicium and the address block is scanned. The scanned information is interpreted and two computer files are produced. At 72, the integrity of the scanned indicium data is verified using error detection/correction code 40. At 74, a global digital token is calculated from the indicium information in lines 14, 16 and 18, except for the indicium global digital token 38. At 76, the global digital token is compared to the indicium global digital token 38. At 78, a query is made as to whether the global digital token matches the indicium global digital token 40. If the verification is not successful then the suspected fraudulent mail piece is investigated at 80. If the query is successful, then at 82, the indicium local digital tokens are used to point to characters in the address block and those characters are compared to the indicium pivotal address characters 26, 28 and 30. At 84, a query is made as to whether the pivotal address characters match the characters pointed to in the address block. If the query is not successful, the suspect fraudulent mail piece is investigated at 80. If the query is successful, the mail piece is delivered at 86. The method verifies the integrity of the indicium by verifying the global digital token and hence the three local digital tokens. Subsequently the correctness of the mapping from local digital token to address block is verified. The difficult and costly part of this process requires accurate automatic scanning and interpretation or recognition of the address block. A method of scanning is described in U.S. Pat. No. 4,725,718 which was incorporated by reference above.

A third method comprises mixed modes of verification combining human and machine verification. In this method, the postal administration automatically verifies the global and local digital tokens and thus assures the integrity of the indicium data. This process requires scanning and interpretation of the indicium data, but not the address block. Mail pieces which pass this test are sent for further processing and delivery. When such a mail piece arrives in a location for final sorting and delivery, mail clerks and carriers visually examine a sample of these mail pieces. This function can also be performed by a separate revenue protection group, such as an inspection service in the United States Postal Service. The process of visual examination involves first reading the local digital tokens and their corresponding pivotal address characters in the indicium, and then verification of the mapping by comparison with the address block. In the case of the example in FIG. 1, the mail carrier will be answering the following three questions: 1) Is the second character from the right in the first line of the address block "e" ?; 2) Is the third character from the left in the second line of the address block "6" ?; and 3) Is the eighth character from the left in the third line of the address block "r"? If the answers to these three questions are affirmative, the mail piece can be delivered, otherwise it is suspect for further investigation.

Figure 5:
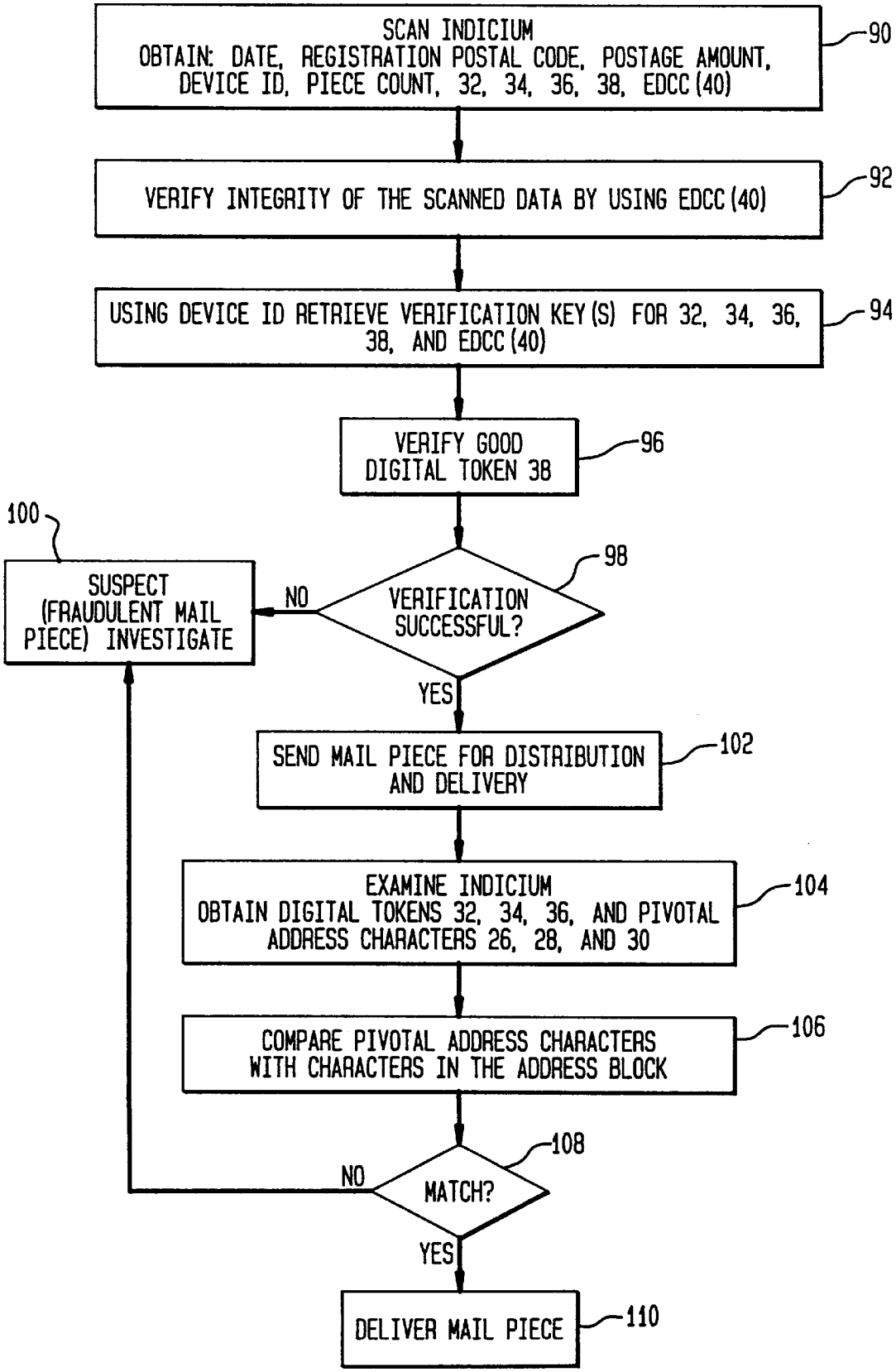
FIG. 5 is a flow chart of another method of indicium verification of the present invention.

FIG. 5 is a flow chart of the third method. At 90, the indicium is scanned to obtain information in lines 14, 16 and 18, except the pivotal address characters 26, 28 and 30. At 92, the integrity of the scanned indicium data is verified by using the error detection/correction code 40. At 94, the device ID is used to retrieve verification key for the local digital tokens 32, 34 and 36 and the global digital token 38. At 96, the global digital token 38 is verified. At 98, the query is made as to whether the verification is successful. If the verification is not successful then the suspected fraudulent mail piece is investigated at 100. If the verification is successful, the mail piece is sent for distribution and delivery at 102. Next, at 104, the indicium is examined in order to obtain the digital tokens 32, 34 and 36 and pivotal address characters. At 106, the pivotal address characters are compared to the address block. At 108, it is determined whether the pivotal address characters match the address block. If the characters do not match, the suspect fraudulent mail piece is investigated at 100. If the characters match, then the mail piece is delivered at 110. In flow chart blocks 90 through 98 verification is performed electronically and in blocks 104 and 106 human verification is performed.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. A method of verifying a postal indicium comprising the steps of:

(a) scanning the indicium to obtain indicium information including a local digital token;

(b) computing a local digital token from the indicium information and a cryptographic key;

(c) comparing the computed local digital token to the scanned local digital token to verify integrity and authenticity of the indicium; and (d) comparing indicium identfication numbers to identification numbers stored in a database to detect unauthorized duplication of the indicium.

2. The method as claimed in claim 1 wherein in step (b) indicium information comprises a mail piece identification, a postage amount, a date, a device identification and a registration postal code.

3. A method of verifying a postal indicium comprising the steps of:

(a) scanning the indicium to obtain indicium information including a global digital token and a pivotal address character;

(b) scanning at least a portion of address block to obtain address block information;

(c) computing a global digital token from the indicium information;

(d) comparing the computed global digital token to the scanned global digital token to verify integrity and authenticity of the indicium;

(e) employing the scanned local digital to ken to obtain a pivotal address character from the address block information; and (f) comparing the scanned pivotal address character with the address block pivotal address character to verify the validity of the indicium.

4. The method as claimed in claim 3 wherein in step (c) the indicium information comprises a mail piece identification, a postage amount, a date, a device identification, a registration postal code, an error detection/correction code, a pivotal address character and a local digital token.

5. A method of verifying a postal indicium comprising the steps of:

(a) scanning the indicium to obtain indicium information;

(b) computing a global digital token from the indicium information;

(c) comparing the computed global digital token with an indicium global digital token to verify the integrity and authenticity of the indicium;

(d) examining manually the indicium to obtain a local digital token and a pivotal address character; and (e) comparing the manually obtained local digital token and pivotal address character to a pivotal address character in the address block to verify the integrity and authenticity of the indicium.

6. A method as claimed in claim 5 wherein in step (b) the indicium information comprises a mail piece identification, a postage amount, a date, a device identification, a registration postal code, an error detection/correction code, a pivotal address character and a local digital token.

7. A method of verifying a postal indicium comprising the steps of:

(a) obtaining indicia information from a mail piece wherein the indicia information contains an indicium pivotal address character;

(b) obtaining address block information from the mail-piece wherein the address block information contains an addressee pivotal address character; and (c) verifying the integrity and authenticity of the indicium information by comparing the indicium pivotal address character to the addressee pivotal address character.

8. The method as claimed in claim 7 where the indicia includes a local digital token employed as a pointer to the addressee pivotal address character in the address block.

9. A mail piece containing an address block and a postal indicium, the postal indicium comprising:

a pointer, said pointer corresponding to a location of an address character; and said address character obtained from the address block from a position corresponding to said pointer.

10. The mail piece as claimed in claim 9 wherein said pointer points to a character position in the address block.

11. The mail piece as claimed in claim 9 wherein said pointer also points to a line number in the address block.

12. A method of applying postage to a mail piece, the method comprising the steps of:

(a) calculating a local digital token from indicia information;

(b) calculating a global digital token from the indicia information;

(c) obtaining a pivotal address character using local digital tokens; and (d) printing a postal indicium containing the pivotal address character, the local digital token and the global digital token.

13. The method as claimed in claim 12 wherein the global digital token is calculated from information contained in the postal indicium comprising the pivotal address characters and the local digital tokens.

* * * * *